US007870895B2

(12) United States Patent
Lucas

(10) Patent No.: US 7,870,895 B2
(45) Date of Patent: Jan. 18, 2011

(54) PACKER

(75) Inventor: Chad M. Lucas, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 576 days.

(21) Appl. No.: 11/836,371

(22) Filed: Aug. 9, 2007

(65) Prior Publication Data

US 2009/0038802 A1 Feb. 12, 2009

(51) Int. Cl.
*E21B 23/04* (2006.01)

(52) U.S. Cl. ..... 166/63; 166/387

(58) Field of Classification Search ..... 166/299, 166/195, 387, 118, 63
See application file for complete search history.

(56) References Cited

U.S. PATENT DOCUMENTS 2,807,325 A * 9/1957 Webb ..... 166/63
3,767,488 A * 10/1973 Seals ..... 149/7
4,306,628 A * 12/1981 Adams et al. ..... 175/4.56
4,662,450 A * 5/1987 Haugen ..... 166/299
5,904,207 A * 5/1999 Rubbo et al. ..... 166/123
5,971,072 A 10/1999 Huber et al.
6,364,017 B1 4/2002 Stout et al.
6,604,582 B2 8/2003 Flowers et al.
7,219,726 B2 5/2007 Zheng et al.
7,243,537 B2 7/2007 Proett et al.
2002/0148611 A1* 10/2002 Williger et al. ..... 166/297
2006/0131014 A1 6/2006 Huang et al.
2008/0314591 A1* 12/2008 Hales et al. ..... 166/285

FOREIGN PATENT DOCUMENTS

GB 2348656 A 10/2000

* cited by examiner

*Primary Examiner*—Daniel P Stephenson
(74) *Attorney, Agent, or Firm*—Trop, Pruner & Hu, P.C.; Rodney V. Warfford; Kevin B. McGoff

(57) ABSTRACT

A packer includes a seal element and a piston. The piston compresses the seal element to form an annular seal in the well. A pressure wave, such as a pressure wave that is caused by a chemical reaction or the detonation of an explosive, is generated in the packer to at least partially assist an operation (the setting of a slip, setting of the seal element, etc.) of the packer. In some implementations, the chemical reaction or explosive detonation occurs in response to a predetermined movement of the piston.

24 Claims, 4 Drawing Sheets

PACKER

BACKGROUND

The invention generally relates to a packer.

A packer is a device that is used in a well to form an annular seal between an inner tubular member and a surrounding outer tubular member (a casing string or a liner, as just a few examples) or borehole wall. As examples, the inner tubular member may be a tubular string (a test string, production string, work string, etc.) or may be part of a downhole tool (a formation isolation valve, bridge plug, etc.).

One type of conventional packer has a seal element that is formed from a set of elastomer seal rings. The rings are sized to pass through the well when the packer is being run downhole into position. When the packer is in the appropriate downhole position and is to be set, gages of the packer compress the rings to cause the rings to radially expand to form the annular seal.

A weight-set packer uses the weight of the string and possibly the weight of additional collars to compress the packer's seal rings. In this regard, when the packer is to be set, the string may be mechanically manipulated from the surface of the well to initiate the release of the weight on the rings.

A hydraulically-set packer uses fluid pressure to compress the seal rings. The fluid pressure may be pressure that is communicated downhole through a tubing string; annulus pressure; pressure that is communicated downhole through a control line; etc.

Other types of packers may include seal elements that are set without using compression. For example, a packer may have an inflatable bladder that is radially expanded to form an annular seal using fluid that is communicated into the interior space of the bladder through a control line. As another example, a packer may have a swellable material that swells in the presence of a well fluid or other triggering agent to form an annular seal.

SUMMARY

In an embodiment of the invention, a packer includes a seal element, a piston and a chemical reactant. The piston compresses the seal element to form an annular seal in the well. The chemical reactant chemically reacts in response to a predetermined movement of the piston to generate a pressure wave to at least partially assist an operation of the packer.

In another embodiment of the invention, a packer includes a seal element, a piston and an explosive. The piston compresses the seal element to form an annular seal in a well. The explosive is adapted to be detonated in response to a predetermined movement of the piston to generate a pressure wave to at least partially assist an operation of the packer.

In another embodiment of the invention, a technique includes moving an element of an actuator associated with setting a packer. The technique includes generating a pressure wave in the packer to at least partially assist an operation of the packer in response to the movement of the element.

In another embodiment of the invention, a packer includes a pressure housing; a slip; a seal element; and a piston that is located in the pressure housing. A mechanism of the packer generates a pressure wave in the housing to at least partially assist the piston in setting the seal element or the slip.

In yet another embodiment of the invention, a technique includes generating a pressure wave in a packer to at least partially assist an operation of the packer.

Advantages and other features of the invention will become apparent from the following drawing, description and claims.

DETAILED DESCRIPTION

Figure 1:
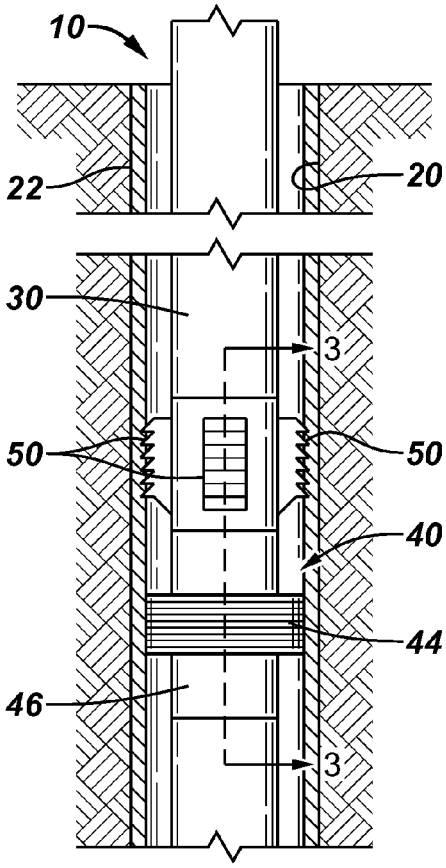
FIG. 1 is a schematic diagram of a well according to an embodiment of the invention.

Referring to FIG. 1, an embodiment 10 of a well in accordance with the invention includes a tubular string 30, which extends downhole into a wellbore 20. As depicted in FIG. 1, in accordance with some embodiments of the invention, the wellbore 20 may be cased with a casing string 22, although the wellbore 20 may be uncased in accordance with other embodiments of the invention. Additionally, although FIG. 1 depicts a vertical wellbore, the wellbore may alternatively be a lateral or a deviated wellbore.

The string 30 includes a packer 40 for purposes of forming an annular seal in the well 10. In this regard, the packer 40 may be run downhole in an unexpanded state, a state in which a resilient annular seal element 44 of the packer 40 is retracted. When the packer 40 is in the appropriate downhole position, measures may then be undertaken (as described herein) to set the packer 40. In general, the setting of the packer 40 causes the packer 40 to compress the seal element 44 to radially expand the element 44 to form the annular seal. Also, when the packer 40 is set, dogs, or slips 50, of the packer 40 radially expand and engage the wall of the casing string 22 to anchor the packer 40 to the string 22. In accordance with other embodiments of the invention, the packer 40 may alternatively be used to seal against surfaces other than the interior surface of a casing string 22, such as the interior surface of a liner or the surface defined by a wellbore wall, as just a few examples.

It is noted that the string 30 is merely an example of one out of many possible conveyance devices that may be used to run the packer 40 downhole. Thus, depending on the particular embodiment of the invention, another conveyance device, such as a wireline, slickline, etc. may be used to run the packer 40 downhole, The conveyance device may or may not (as depicted in FIG. 1) contain a packer setting tool, depending on the particular embodiment of the invention. For embodiments of the invention in which the string 30 is used, the string 30, may as examples, be a coiled tubing string or may be formed from jointed tubing sections.

As described herein, the packer 40 includes a mechanism to generate a pressure surge, or wave, inside the packer 40 for purposes of at least partially assisting an operation of the packer, such as an operation that is connected with the setting of the packer 40 (i.e., an operation that involves the radial expansion of the resilient element 40 and/or the radial expansion of the slips 50). Depending on the particular embodiment of the invention, the force that is generated by the pressure wave may be the primary force that drives the operation or may, alternatively, be a secondary force to supplement a primary force that is generated using a mechanically or hydraulically driven actuator (a conventional hydraulically-set or weight-set packer actuator, for example).

Figure 2:
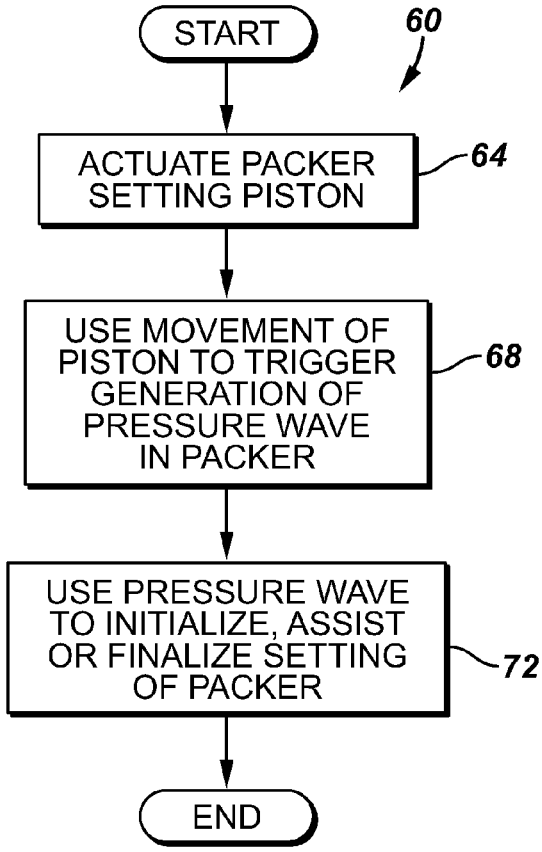
FIG. 2 is a flow diagram depicting a technique that uses a pressure surge to at least partially assist an operation of a packer of FIG. 1 according to an embodiment of the invention.

The generation of the pressure wave inside the packer 40 is triggered by the mechanical movement of an actuator element of the packer 40, in accordance with some embodiments of the invention. More specifically, referring to FIG. 2, a technique 60 in accordance with embodiments of the invention includes beginning the setting process for a packer by actuating a packer setting piston, pursuant to block 64. The movement of the piston is used (block 68) to trigger the generation of a pressure wave inside the packer. This pressure wave is used, pursuant to block 72, to initialize, assist or finalize the setting of the packer.

Figure 3:
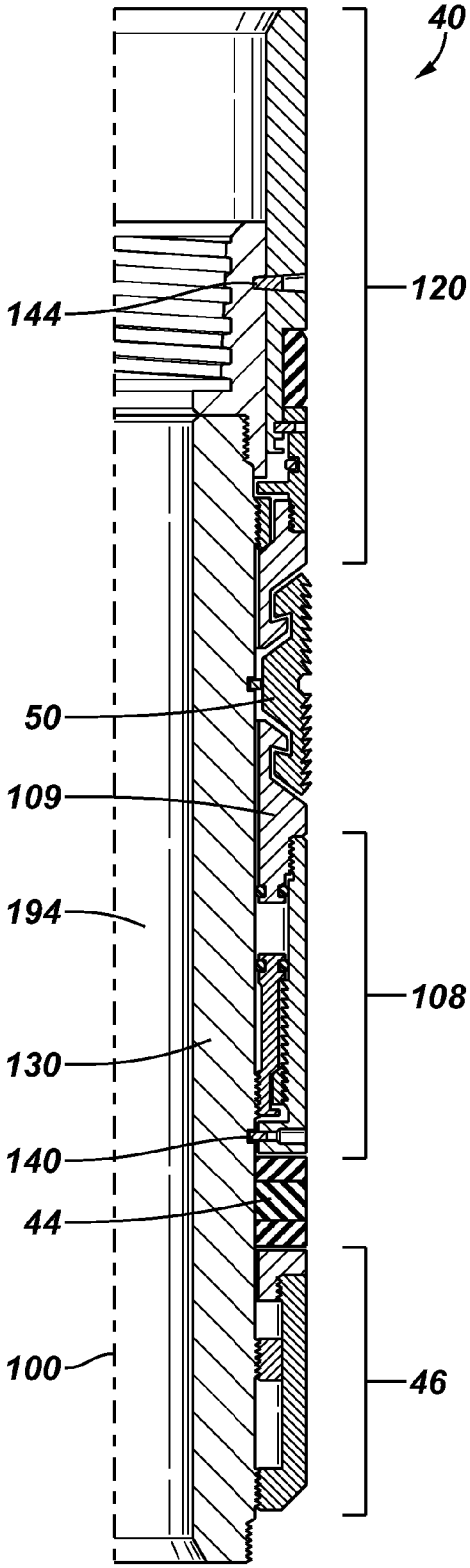
FIG. 3 is a partial cross-sectional view of the packer taken along line 3-3 of FIG. 1 according to an embodiment of the invention.

As a more specific example, FIG. 3 depicts a partial cross-sectional view of the packer 40 in accordance with some embodiments of the invention. FIG. 3 depicts a right-hand cross-sectional view of the packer 40 about a longitudinal axis 100 and is taken along line 3-3 of FIG. 1. The longitudinal axis 100 is coaxial with the string 30 (see FIG. 1) near the packer 40. As can be appreciated by one of skill in the art, the true cross-section of the packer 40 also includes a mirroring left-hand cross-section on the left-hand side of the longitudinal axis 100, as the packer 40 is generally symmetrical about the longitudinal axis 100.

As depicted in FIG. 3, the packer 40 includes the seal element 44, which may be formed from multiple sealing rings. The number of sealing rings, whether more or less than the three sealing rings that are depicted in FIG. 3, may be selected based on the expected environment of the packer and the overall application for which the packer 40 is to be used. It is noted that the seal rings may be formed from an elastomer, or may be formed from other materials. For example, in accordance with other embodiments of the invention, all or part of the seal rings may be formed from a swellable material, plastic, composite, or combination of materials. Thus, many variations are contemplated and are within the scope of the appended claims.

In general, the seal element 44, when radially expanded, is compressed between a relatively stationary lower assembly 46 and a moveable, packer setting piston 108. Thus, to set the packer 40 for the orientation that is shown in FIG. 3, the piston 108 moves in a downward direction to axially compress the seal element 44 between a piston head 154 of the piston 108 and the lower assembly 46. The lower assembly 46 and the piston 108 are generally mounted on and surround a tubular inner carrier mandrel 130. The interior passageway of the carrier mandrel 130 forms a corresponding central passageway 194 through the packer 40, which is in fluid communication with the central passageway of the tubular string 30 (see FIG. 1).

As depicted in FIG. 3, the upper end of the piston 108 is connected to a lower cone 109, which, in turn, is connected to the lower side of the depicted slip 50. The upper side of the slip 50 is connected to a upper cone assembly 120. The upper cone assembly 120 and the piston 108 form part of an actuator of the piston 40.

When the packer 40 is run downhole, the packer 40 is configured in a run-in-hole state, a state in which the assembly 120 and piston 108 are secured to the inner carrier mandrel 130 via shear pins 140 and 144 (as an example). Thus, when the packer 40 is in its run-in-hole state, movement of the piston 108 is prevented. When the packer 40 is to be set, however, the packer's actuator (under the influence of a mechanically or hydraulically generated force, as examples) produces a downward force on the assembly 120, slips 50 and piston 108. This downward force, in turn, shears the pins 140 and 144 to release the piston 108 and assembly 120, and allow these components to move axially relative to the inner carrier mandrel 130. In general, the downward movement of the element 120 and piston 108 causes the outward radial expansion of the slips 50 due to the interaction of the upper and lower cone elements with the corresponding inclined faces of the slip 50.

As described herein, the packer 40 contains an explosive or chemical reactant to generate an internal pressure surge, or wave, to at least partially assist the setting of the slips 50 and/or the setting of the seal element 44.

It is noted that although the seal 44 is depicted as being below the slips 50, the seal 44 may be above the slips 50 in other embodiments of the invention. Furthermore, the setting may take place from a top-down direction as described in connection with FIG. 3 or a bottom-up direction, depending on the particular embodiment of the invention. Thus, many variations are contemplated, and all such variations are considered to be within the scope of the appended claims.

Figure 4:
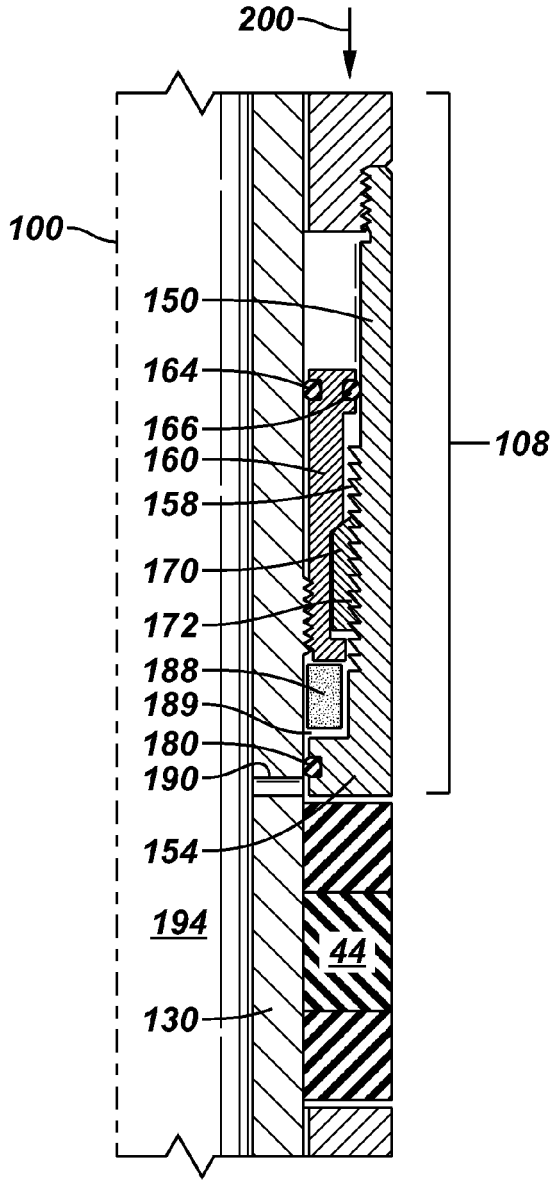
FIG. 4 is a more detailed cross-sectional view of part of the packer according to an embodiment of the invention.

As a more specific example, FIG. 4 depicts a more detailed view of the cross-section shown in FIG. 3, illustrating in particular the piston 108 and pressure surge generating components, in accordance with some embodiments of the invention. Referring to FIG. 4, the piston 108 includes an operator mandrel 150 and a lower piston head 154. An annular cavity 189 exists between the inner surface of the operator mandrel 150 and the outer surface of the inner carrier mandrel 130 (i.e., the cavity 189 is located inside a sealed pressure housing of the packer 40).

In accordance with some embodiments of the invention, a chemical reactant 188 is disposed in the annular cavity 189 for purposes of generating the pressure wave. In the packer's run-in-hole state (i.e., the initial state of the packer 40), the annular cavity 189 is sealed due to, for example, an o-ring 180 that is located between the piston head 154 and the outer surface of the inner carrier mandrel 130, and seals that are formed from a sealing body 160. More specifically, the sealing body 160 is located above the annular chamber 189, is attached to the outer surface of the inner carrier mandrel 130 and includes inner 164 and outer 166 O-rings to form corresponding seals between the inner surface of the operator mandrel 150 and the outer surface of the carrier mandrel 130.

As shown in FIG. 4, a ratchet pawl 170 may be disposed in an outside annular cavity of the seat body 160. In general, the pawl 170 has ratchet teeth 172, which engage mating ratchet teeth 158 that are formed on the inner surface of the mandrel 150 for purposes of locking the piston 108 in position as the piston 108 moves downwardly to set the packer 40.

A catalyst reacts with the chemical reactant 188 to generate the pressure wave inside the packer 40. Due to the above-described initial isolation of the chamber 189 when the packer 40 is run downhole, the chemical reactant 188 is isolated from the catalyst. However, when a force 200 is applied by the packer's actuator to cause downward movement of the piston 108, the piston 108 eventually travels to a position that allows a catalyst to be leaked into the chamber 189. The presence of the catalyst in the chamber 189, in turn, causes the chemical reactant 188 to react to generate the pressure wave.

As an example of one out of many possible embodiments of the invention, FIG. 4 depicts a radial port 190 in the inner carrier mandrel 130 for the purpose of communicating the catalyst into the chamber 189 when the piston 108 has reached a given position. More specifically, in accordance with some embodiments of the invention, the catalyst may be a well fluid that is communicated through the central passageway 194 of the packer 40 and is used to activate the chemical reactant 188 to initiate the pressure wave. Thus, as shown in FIG. 4, initially, the lower seal that is provided by the o-ring 180 is located above the radial port 190 to maintain isolation of the catalyst from the chemical reactant 188. However, upon sufficient downward travel of the piston 108, the o-ring 180 moves past the port 190 to breach the lower seal of the chamber 189 to permit the catalyst to flow into the chamber 189.

In other embodiments of the invention, as an alternative to the radial port 190, one or more o-rings (such as the o-ring 180, for example) may provide leak path(s) into the chamber 189 due to the o-ring(s) leaving their respective sealing surfaces for purposes of communicating the catalyst into the chamber 189.

Figure 5:
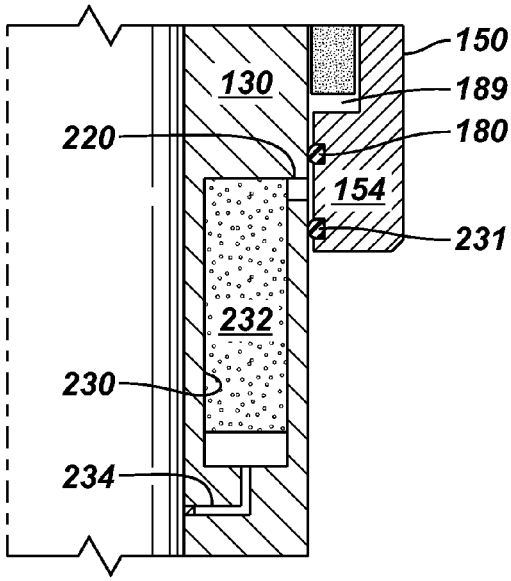
FIGS. 5, 6, 8 and 9 depict features of packers in accordance with other embodiments of the invention.

Other mechanisms may be used for purposes of establishing communication between the chemical reactant 188 and a catalyst upon sufficient movement of the piston 108. As another example, FIG. 5 depicts a chamber 230, which may be located, for example, in the carrier mandrel 130, for purposes of storing a catalyst 232. As an example, the chamber 230 may be initially filled with the catalyst 232 via a fill port 234. The chamber 230 has a radial port 220 that is initially sealed off between a lower o-ring 231 (formed between the piston head 154 and the outer surface of the carrier member 130) and the o-ring 180. However, upon sufficient movement of the piston 108 in a downwardly direction, the catalyst 232 flows into the chamber 189, thereby initiating the chemical reaction and causing the generation of the pressure wave.

Figure 7:
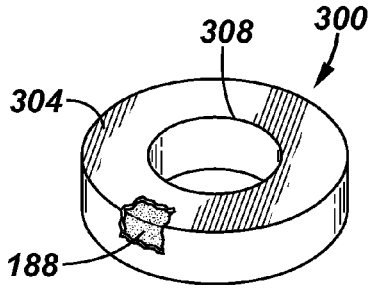
FIG. 7 is a perspective view of a chemical reactant module according to an embodiment of the invention.

In accordance with some embodiments of the invention, the chemical reactant 188 may be encapsulated with a protective coating for purposes of preventing premature reaction of the reactant 188. For example, FIG. 7 depicts an encapsulated reactant module 300, which includes a protective coating 304 that surrounds the chemical reactant 188. Although the module 300 is depicted in FIG. 7 as being annular (and thus, having a centralized opening 308 for the inner carrier mandrel 130), the module 300 may have other shapes in accordance with other embodiments of the invention.

It is noted that the module 300, when immersed in the catalyst, causes the protective coating 304 to dissolve. Alternatively, a chemical other than the catalyst, which is specifically designed to dissolve the coating 304 may be used to first dissolve the coating 304 before or commensurate with the introduction of the catalyst into the chamber 189, in accordance with other embodiments of the invention. Thus, many variations are contemplated and are within the scope of the appended claims.

Figure 6:
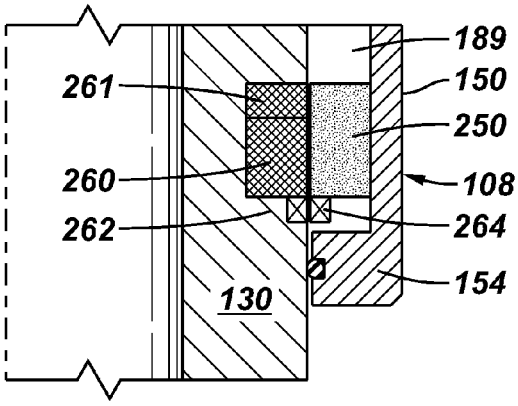

Mechanisms other than chemical reactants may be disposed in the annular chamber 189 to generate the pressure surge in accordance with other embodiments of the invention. For example, FIG. 6 depicts an embodiment of the invention in which an explosive 250 is disposed in the annular chamber 189. For this embodiment of the invention, the packer 40 includes a detonator 260 (an exploding foil initiator (EFI), for example), which is activated to detonate the explosive 250 when the piston 108 reaches a predetermined downward position.

As shown in FIG. 6, the detonator 260 may be electrically coupled to a downhole energy source 261, such as a battery, for example. As depicted in FIG. 6, for purposes of sensing the position of the piston 108, the packer 40 may include a sensor 262 that detects a particular feature of the piston 108, such as an embedded magnet 264, as an example. The detonator 260, energy source 261 and sensor 262 may be located in the carrier mandrel 130. It is noted, however, that the arrangement that is depicted in FIG. 6 is merely an example, as many other variations are contemplated and are within the scope of the appended claims.

Figure 8:
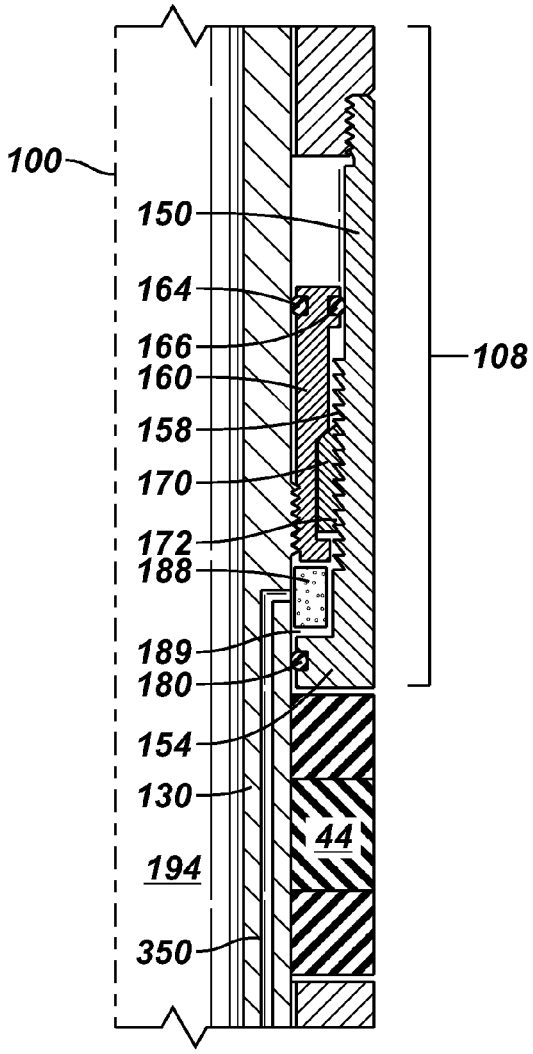

Other variations are contemplated and are within the scope of the appended claims. For example, in accordance with other embodiments of the invention, no initial mechanical movement of the piston 108 may be required to initiate the generation of the pressure wave. More specifically, in accordance with some embodiments of the invention, the pressure wave is the sole force (i.e., the primary and only force) that is used to drive the piston 108 and set the slips 50 and/or seal element 44. FIG. 8 depicts an exemplary embodiment of such a packer in accordance with some embodiments of the invention. The packer that is depicted in FIG. 8 has a similar design to the packer that is depicted in FIG. 4, with similar reference numerals being used to depict similar components. However, unlike the packer that is depicted in FIG. 4, the packer of FIG. 8 does not receive a mechanically or hydraulically-generated force 200 to initiate and at least partially drive the piston 108. Instead, when the packer is to be set, a catalyst is communicated into the chamber 189 for purposes of causing the chemical reactant 188 to react. The reaction, in turn, produces sufficient force to release the piston 108 from the inner carrier mandrel 130 (to shear any shear pins securing the piston 108 from the mandrel 130, for example) and drive the piston 108 downwardly to radially extend the slips 50 and sufficiently compress the seal element 44 to form the desired annular seal in the well.

According to some embodiments of the invention, the communication of the catalyst into the chamber 189 may occur through a control line (not shown in FIG. 8) or may occur through a longitudinal passageway 350 that is formed in the carrier mandrel 130 (as depicted in FIG. 8). In this regard, as examples, a sleeve (not shown in FIG. 8) of the packer may be actuated to expose the passageway 350 to fluids inside the central passageway 194 or the annulus of the well for purposes of communicating a catalyst into the annular chamber 189. The sleeve may be controlled mechanically or by wired or wireless stimuli that are communicated from the surface of the well, as just a few examples. It is noted that the longitudinal passageway 350 and the above-described control is merely provided as an example, as many other mechanisms and techniques may be used to initially isolate the annular chamber 189 from a catalyst and thereafter communicate the catalyst into the chamber 189 when the packer is to be set.

Figure 9:
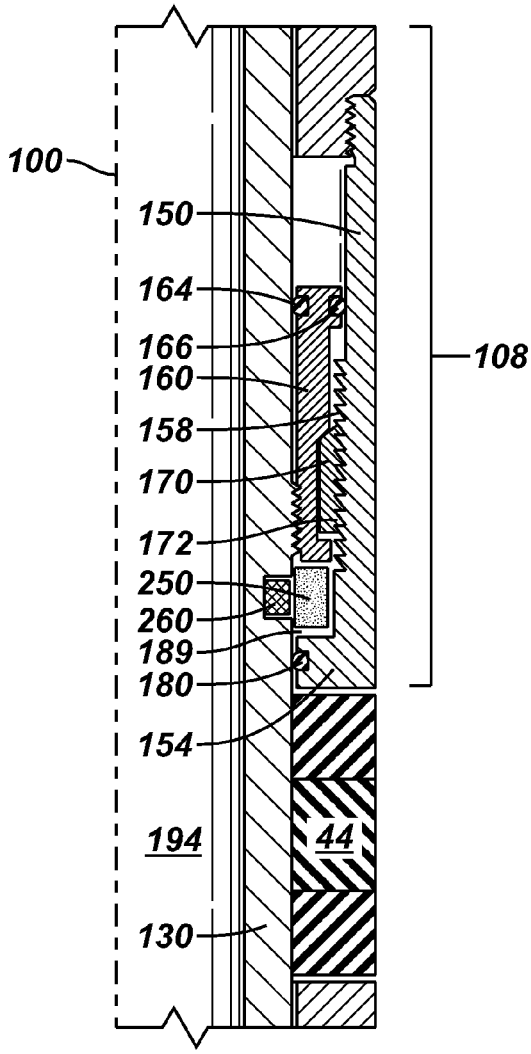

FIG. 9 depicts an exemplary embodiment of the packer according to another embodiment of the invention. In this embodiment, the explosive 250 is disposed in the annular chamber 189 and is detonated by the detonator 260, when the packer is to be set. Thus, initial movement of the piston 108 is not required to trigger the generation of the pressure wave, as the explosive 250 may be detonated by communicating (via wired or wireless stimuli, for example) with the detonator 260 from the surface of the well, as an example. The pressure wave may be the sole source of force that is used to radially expand the slips 50 and/or form the annular seal from the annular element 44 in accordance with some embodiments of the invention.

While directional terms and terms of orientation, such as "up," "down," "left," "right," etc. are used herein for purposes of convenience to describe the packers and associated systems, it is understood that these directions and orientations are not needed to practice the claimed invention. As examples, any of the packers that are disclosed herein may be rotated by one hundred eighty degrees, may be used in lateral or deviated wellbores, etc., in other embodiments of the invention.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A packer comprising:

a seal element;

a piston to compress the seal element to form an annular seal in a well; and a chemical reactant to chemically react in response to a predetermined movement of the piston to generate a pressure wave to at least partially assist an operation of the packer.

2. The packer of claim 1, further comprising:

a protective coating on the chemical reactant to prevent premature reaction of the chemical reactant.

3. The packer of claim 1, wherein the chemical reactant is adapted to reactant in response to the piston moving a predetermined distance.

4. The packer of claim 1, further comprising:

a mechanical actuator to cause initial movement of the piston prior to the generation of the pressure.

5. The packer of claim 1, further comprising:

a pressure housing to contain the chemical reactant.

6. The packer of claim 1, wherein the packer comprises a communication path to communicate a catalyst to the chemical reactant in response to the piston moving to a predetermined position.

7. The packer of claim 1, further comprising:

a reservoir to store a catalyst, wherein the packer is adapted to establish communication between the reservoir and the chemical reactant in response to the piston moving to a predetermined position.

8. The packer of claim 1, wherein the pressure wave at least partially assists in radially expanding the resilient element to form the seal.

9. The packer of claim 1, further comprising:

slips adapted to radially expand to anchor the packer to a well casing, wherein the pressure wave at least partially assists in radially expanding the slips.

10. A packer comprising:

a seal element;

a piston to compress the seal element to form an annular seal in a well; and an explosive adapted to be detonated in response to a predetermined movement of the piston to generate a pressure wave to at least partially assist an operation of the packer.

11. The packer of claim 10, wherein the explosive is adapted to be detonated in response to the piston moving a predetermined distance.

12. The packer of claim 10, further comprising:

a mechanical actuator to cause initial movement of the piston prior to the generation of the pressure wave.

13. The packer of claim 10, further comprising:

a detonator to detonate the explosive in response to the piston moving to a predetermined position.

14. The packer of claim 10, wherein the pressure wave at least partially assists in radially expanding the resilient element to form the annular seal.

15. The packer of claim 10, further comprising:

slips adapted to radially expand to anchor the packer to a well casing, wherein the pressure wave at least partially assists in radially expanding the slips.

16. A method comprising:

moving an element of an actuator of a packer in connection with an operation of the packer; and using the movement of the element to trigger initiation of a pressure wave in the packer to at least partially assist the operation.

17. The method of claim 16, wherein the act of generating the pressure wave comprises reacting a chemical reactant inside the packer.

18. The method of claim 16, wherein the act of generating the pressure wave comprises detonating an explosive in response to the movement of the element.

19. The method of claim 16, further comprising:

using the pressure wave to at least partially assist in setting the packer.

20. The method of claim 16, further comprising:

using the pressure wave to at least partially assist in setting a slip of the packer.

21. A packer comprising:

a pressure housing;

a slip;

a seal element;

a piston located in pressure housing; and a mechanism to adapted to respond to movement of the piston to trigger initation of a pressure wave in the housing to at least partially assist the piston in setting the seal element or the slip.

22. The packer of claim 21, wherein the mechanism comprises an explosive adapted to detonate to generate the pressure wave.

23. The packer of claim 21, wherein the mechanism comprises a chemical adapted to chemically react to generate the pressure wave.

24. The packer of claim 21, further comprising a sealed chamber in the pressure housing, the sealed chamber containing both the piston and the mechanism.

* * * * *